299-13 SR
7/21/81 XR 4,279,444

United States Patent [19] [11] 4,279,444
Kilburn [45] Jul. 21, 1981

[54] JETTING OUT WEAK AREAS FOR FORMING AN IN SITU OIL SHALE RETORT

[75] Inventor: James Kilburn, Idaho Falls, Id.

[73] Assignee: Occidental Oil Shale, Inc., Grand Junction, Colo.

[21] Appl. No.: 109,838

[22] Filed: Jan. 7, 1980

[51] Int. Cl.[3] ..... E21B 43/247; E21B 43/263
[52] U.S. Cl. ..... 299/2; 166/259; 299/13; 299/17
[58] Field of Search ..... 166/256, 259, 299, 63; 299/2, 16, 17, 13, 4

[56] References Cited

U.S. PATENT DOCUMENTS

| | | | |
|---|---|---|---|
| 2,561,639 | 7/1951 | Squires | 299/17 X |
| 3,739,851 | 6/1973 | Beard | 166/254 |
| 3,753,594 | 8/1973 | Beard | 299/4 |
| 3,779,601 | 12/1973 | Beard | 299/4 |
| 3,905,430 | 9/1975 | Poundstone | 299/17 X |
| 3,957,306 | 5/1976 | Closmann | 299/4 |
| 4,043,598 | 8/1977 | French et al. | 299/13 X |
| 4,109,964 | 8/1978 | Ridley | 166/259 X |
| 4,118,070 | 10/1978 | French et al. | 166/259 X |
| 4,185,693 | 1/1980 | Crumb et al. | 166/259 |

OTHER PUBLICATIONS

Maurer, *Novel Drilling Techniques,* 1968, Pergamon Press, N.Y., pp. 39–44.

*Primary Examiner*—Stephen J. Novosad
*Attorney, Agent, or Firm*—Christie, Parker & Hale

[57] ABSTRACT

An in situ oil shale retort is formed in a subterranean formation containing oil shale. A void can be formed in formation within the retort site by directing fluid under pressure against a zone of relatively weakened formation, such as tuffs, gravel beds, or fractured oil shale, to erode such weakened formation into particle form, leaving a void space adjacent a remaining zone of unfragmented formation within the retort site. The void space can be formed by drilling a bore hole into the zone of weakened formation, placing a jet nozzle in the bore hole, and forcing a fluid such as water through the nozzle against the weakened formation for eroding it to form the void space. Eroded formation particles are passed to the bottom of the bore hole. Such water jetting techniques can be used to form voids in zones of weakened formation interspersed throughout the retort site. Remaining formation within the retort site is explosively expanded toward such a void space for forming a fragmented permeable mass of formation particles containing oil shale in an in situ oil shale retort. The amount of eroded formation particles jetted from the retort site can be measured prior to explosive expansion for providing a selected void fraction in the resulting fragmented mass. Explosive also can be placed in voids excavated by such jetting for such explosive expansion.

18 Claims, 5 Drawing Figures

JETTING OUT WEAK AREAS FOR FORMING AN IN SITU OIL SHALE RETORT

BACKGROUND OF THE INVENTION

This invention relates to recovery of liquid and gaseous products from subterranean formations containing oil shale, and more particularly, to techniques for forming a void space in an in situ oil shale retort site in preparation for explosively expanding formation within the retort site.

The presence of large deposits of oil shale in the Rocky Mountain region of the United States has given rise to extensive efforts to develop methods for recovering shale oil from kerogen in the oil shale deposits. The term "oil shale" as used in the industry is, in fact, a misnomer; it is neither shale, nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein, and the liquid hydrocarbon product is called "shale oil".

A number of methods that have been proposed for processing oil shale involve either first mining the kerogen-bearing shale and processing the shale on the ground surface, or processing the shale in situ. The latter approach is preferable from the standpoint of environmental impact, since the treated shale remains in place, reducing the chance of surface contamination and the requirements for disposal of solid wastes.

The recovery of liquid and gaseous products from oil shale deposits has been described in several patents, such as U.S. Pat. Nos. 3,661,423; 4,043,595; 4,043,596; 4,043,596; 4,043,597 and 4,043,598, which are incorporated herein by this reference. These patents describe in situ recovery of liquid and gaseous hydrocarbon materials from a subterranean formation containing oil shale wherein such formation is fragmented by explosive expansion techniques to form a stationary, fragmented permeable body or mass of formation particles containing oil shale within the formation, referred to herein as an in situ oil shale retort.

In forming such a fragmented mass, at least one void is excavated from formation within the retort site, leaving a remaining portion of unfragmented formation within the retort site adjacent the void. Explosive is loaded into blasting holes drilled in the remaining portion of unfragmented formation. The explosive is detonated for explosively expanding the remaining portion of unfragmented formation toward the free face of formation adjacent the void for forming a fragmented permeable mass of formation particles containing oil shale in an in situ oil shale retort.

During retorting, hot retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the fragmented mass and introducing an oxygen-supplying gaseous combustion zone feed into the fragmented mass to advance the combustion zone through the fragmented mass. In the combustion zone, oxygen in the combustion zone feed is depleted by reaction with hot carbonaceous materials to produce heat, combustion gas, and combusted oil shale. By continued introduction of the combustion zone feed into the fragmented mass, the combustion zone is advanced through the fragmented mass.

The combustion gas and the portion of the combustion zone feed that does not take part in the combustion process pass through the fragmented mass on the advancing side of the combustion zone. This heats the oil shale in a retorting zone to a temperature sufficient to produce kerogen decomposition, called "retorting", in the oil shale. The kerogen decomposes to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas also is withdrawn from the bottom of the retort. The off gas contains combustion gas, including carbon dioxide generated in the combustion zone, gaseous products produced in the retorting zone, carbon dioxide from carbonate decomposition, and any gaseous retort inlet mixture that does not take part in the combustion process. The products of retorting are referred to herein as liquid and gaseous products.

U.S. Pat. Nos. 4,043,595 and 4,043,596 disclose methods for excavating a void space within a retort site in preparation for explosively expanding formation containing oil shale for forming an in situ oil shale retort. According to a method disclosed in those patents, formation within the retort site is excavated to form a columnar void in the form of a narrow vertical slot bounded by unfragmented formation having a vertically extending free face within the retort site. Blasting holes are drilled adjacent the slot and parallel to the free face, the blasting holes are loaded with explosive, and the explosive is detonated for explosively expanding unfragmented formation within the retort site toward the slot for forming a fragmented permeable mass of formation particles containing oil shale in an in situ oil shale retort. In one embodiment, the vertical slot is centered within the retort site, and the height of the slot extends essentially the entire vertical dimension of the retort being formed, and the length of the slot extends essentially the entire distance between opposite side walls of the retort being formed. The slot can be over 200 feet in height, over 120 feet in length, and about 18 feet wide.

In one embodiment, a vertical slot is excavated by initially drilling and forming a 4-foot diameter raise the height of the retort being formed. The raise is bored in the center of the slot being formed, and rows of blasting holes are drilled on opposite sides of the raise. The blasting holes are the same height as the slot being formed. The blasting holes are loaded with explosive, and such explosive is detonated in increments to explosively expand formation toward the free face provided by unfragmented formation surrounding the raise for enlarging the raise in steps progressing lengthwise along the slot being formed. Drilling and blasting sequences are repeated until the length of the slot is enlarged the full width of the retort being formed. Explosive is then loaded into unfragmented formation remaining within the retort site adjacent the void and detonated in a single round for explosively expanding the remaining formation toward the slot for forming the fragmented mass. A more complete description of the techniques for forming the slot is disclosed in U.S. Pat. Nos. 4,043,595 and 4,043,596.

U.S. Pat. Nos. 4,043,597 and 4,043,598 disclose an alternative method for forming a void space within a retort site in preparation for forming a fragmented mass. According to a method disclosed in those patents, three vertically spaced apart horizontal voids are excavated within the boundaries of a retort site. Separate vertically spaced apart horizontal retort level access drifts are excavated on upper, intermediate and lower levels of the retort site. A separate rectangular horizontal void is excavated at each retort access level so that a respective retort access level drift extends to and from the horizontal void being formed. The horizontal cross section of each horizontal void is substantially similar to that of a retort being formed. Blasting holes are drilled in upper, intermediate and lower zone of unfragmented formation adjacent the horizontal voids. Explosive is loaded into the blasting holes, and the explosive is detonated in a single round for explosively expanding the zones of unfragmented formation toward the horizontal free faces of formation adjacent the voids for forming a fragmented mass. Further details of techniques for forming retorts using such horizontal void volumes are more fully described in U.S. Pat. Nos. 4,043,597 and 4,043,598.

In certain instances, oil shale deposits can lend themselves to development according to principles of this invention wherein a void space can be formed within an in situ oil shale retort site in lieu of excavating a vertical slot or a plurality of horizontal voids as described above. Within an oil shale deposit there can be an extremely large number of generally horizontal deposition layers containing kerogen, as well as other minerals and rock materials interspersed between the layers containing kerogen. Some of these other minerals or rock materials can occur in deposition layers or strata several feet thick. These other minerals or rock materials can be softer than formation containing kerogen, or they can occur as relatively loose or porous deposition layers when compared to kerogen which can occur in more compact or solid deposition layers. For example, mineral deposits such as tuff can occur in oil shale deposits, and tuff is softer than formation containing kerogen which occurs in compact or solid deposition layers. Layers of gravel also can be interspersed throughout formation containing oil shale, and such layers are more loose or porous when compared with compact or solid kerogen deposition layers. Formation strata containing fractured oil shale, including fractured kerogen deposits, also can occur in formation strata throughout an oil shale deposit. It can be desirable to form a void space within zones of formation containing such soft, loose, porous or fractured material in lieu of, or in combination with, forming a void space by excavating a vertical slot or horizontal void volumes as described above. Such relatively weak deposition layers are commonly low in kerogen content and therefore the waste resulting from forming the void spaces is relatively low. It can also be desirable, particularly in a horizontal void volume system, to form voids for placement of explosive in weak deposition layers which commonly extend horizontally through the formation, i.e., parallel to the free face toward which formation is explosively expanded.

SUMMARY OF THE INVENTION

Briefly, an in situ oil shale retort is formed in a retort site in a subterranean formation containing oil shale, wherein formation within a retort site in such formation is explosively expanded toward a void formed in the retort site for forming an in situ oil shale retort containing a fragmented permeable mass of formation particles containing oil shale. According to one embodiment of this invention, fluid under pressure from a jet nozzle placed in the formation is forced against a first zone of formation having a relatively lower resistance to erosion for eroding such formation into particle form and removing the eroded formation particles for forming a void in the first zone of formation adjacent a second zone of formation having a relatively higher resistance to erosion. Formation within the second zone of formation is explosively expanded toward the void formed in the first zone of formation for forming a fragmented permeable mass of formation particles containing oil shale in an in situ oil shale retort.

In another embodiment of the invention, the void can be formed by drilling a bore hole through the first zone of formation, and directing a jet stream of fluid outwardly from a jet nozzle placed in the bore hole for eroding or disintegrating formation within the first zone of formation to form a void in the first zone. Such a jet stream can be provided by directing a fluid, such as water, under pressure against formation within the first zone to form the desired void. Formation material within the first zone can be water insoluble, such a fractured oil shale or gravel beds. The water jet can wash particles from the first zone, and the amount of removed particles can be measured for determining the void volume of the void produced by the water jetting techniques. If desired, void spaces can be excavated by conventional mining techniques and a void formed by such fluid jetting can receive explosive for explosive expansion toward an excavated void space.

DRAWINGS

Features of specific embodiments of the best mode contemplated for carrying out the invention are illustrated in the drawings, in which.

DETAILED DESCRIPTION

Figure 2:
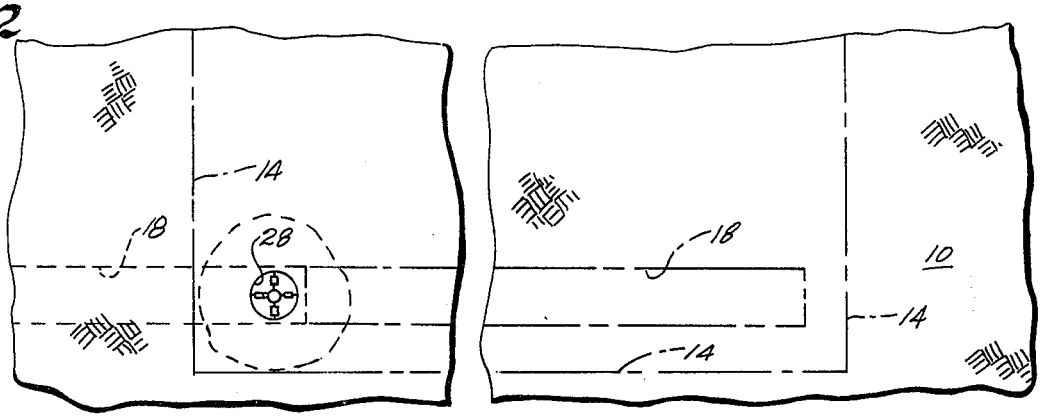
FIG. 2 is a fragmentary, semi-schematic, horizontal cross-sectional view taken along line 2—2 of FIG. 1.
Figure 1:
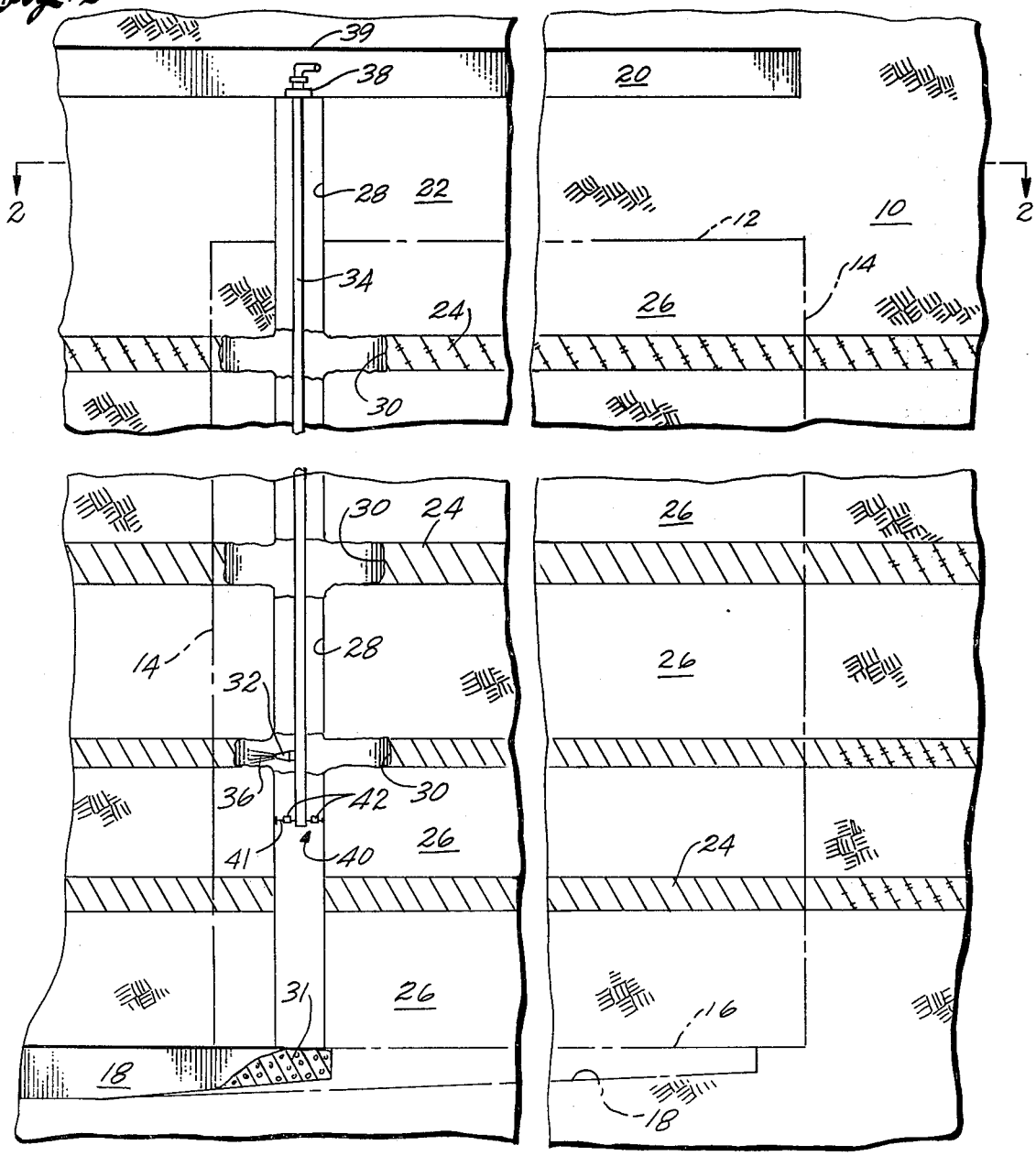
FIG. 1 is a fragmentary, semi-schematic, vertical cross-sectional view showing a subterranean formation containing oil shale in which weak areas of the formation are removed by fluid jetting techniques, according to principles of this invention, for forming a void space within an in situ oil shale retort site.

FIGS. 1 and 2 illustrate an in situ oil shale retort being formed in a subterranean formation 10 containing oil shale in accordance with principles of this invention. FIGS. 1 and 2 are semi-schematic vertical and horizontal cross-sections, respectively, at one stage during preparation of the in situ retort. As shown in FIGS. 1 and 2, the in situ retort is rectangular in horizontal cross-section, and as shown in phantom lines in FIG. 1, the retort being formed has a top boundary 12, four vertically extending side boundaries 14, and a lower boundary 16. A first drift 18 is excavated at a production level below the lower boundary 16 for providing a means for access to a lower portion of the retort being formed.

The in situ oil shale retort is formed by excavating a portion of the formation to form an open base of operation 20 on an upper working level. The floor of the base of operation 20 is spaced above the upper boundary 12 of the retort being formed, leaving a horizontal sill pillar 22 of unfragmented formation between the bottom of the base of operation and the upper boundary 12 of the retort being formed. The horizontal extent of the base of operation is sufficient to provide effective access to substantially the entire horizontal cross-section of the retort being formed. Such a base of operation provides access for excavating operations for forming void spaces within the retort site according to principles of this invention. The base of operation also provides access for drilling and explosive loading for subsequently explosively expanding formation toward such void spaces to form a fragmented permeable mass of formation particles containing oil shale in the retort being formed. The base of operation 20 also facilitates introduction of oxygen-supplying gas into the top of the fragmented mass formed below the horizontal sill pillar 22.

Formation containing oil shale generally comprises layers containing kerogen cemented together in the form of a hard, compact rock material. Zones of weakened formation can be dispersed throughout hard, compact formation containing kerogen. FIG. 1 illustrates an example of such weakened zones dispersed throughout more compact, harder formation containing kerogen. The region of formation illustrated in FIG. 1 includes a plurality of first zones 24 of weakened formation occurring as vertically spaced apart formation deposition layers or strata between second zones 26 of more compact, harder formation containing kerogen. Such strata or zones 24 of weaker formation can be several feet thick and can extend in generally horizontal planes through the formation, including throughout the entire horizontal cross-section of the retort site. The first zones 24 of weaker formation can be characterized as being either softer, looser, more porous, or weaker in cohesive strength than the second zones 26 of compact formation; and as a result, such zones of weaker formation have a relatively lower resistance to fluid erosion than the zones of more compact formation. That is, the weaker zones can be eroded, or disintegrated, or broken into particles in response to mechanical action from contact with high pressure fluid jets being directed against formation within the weaker zones; whereas formation within the more compact zones can remain essentially intact, or at least does not break into particle form, or erode in response to fluid under the same amount of pressure being directed against it. Thus, fluid under pressure directed against the relatively weaker formation can break apart such weakend formation and remove it from its formation strata and form void spaces therein, while the adjacent zones of more compact formation can remain intact, or at least unfragmented adjacent the void spaces thus formed. In some instances, erosion of such weaker zones of formation can cause caving of more compact, harder zones of formation above portions of the weaker zones which have been eroded.

As examples of such relatively weaker zones of formation, minerals or rock materials, such as tuffs or gravel beds, can be deposited as loose, softer, or more porous layers or strata within harder, more compact formation containing kerogen. Formation containing oil shale also can have regions containing kerogen wherein the kerogen deposits are fractured, rather than being cemented together into compact layers. Fractures also can be present in sedimentary deposits of minerals or rock materials other than kerogen containing layers in formation containing oil shale. Such regions of fractured formation can occur in layers or strata several feet thick extending through the formation containing oil shale, including throughout the entire horizontal cross-section of the in situ oil shale retort site. It can be desirable to remove such regions of fractured formation from the retort site to leave more structurally sound compact formation within the retort site.

Thus, formation within the first zone of weakened formation can be any of such zones of material containing fractured oil shale, or other fractured material, or other minerals or rock materials which are softer, looser or more porous than the harder, more compact formation containing kerogen which is present in the second zone of formation. The first zones of formation are referred to below as weaker zones or weakened formation, for simplicity, and the second zones of harder, more compact formation containing kerogen are referred to below as more compact zones or compact formation, for simplicity.

According to principles of this invention, void spaces can be formed in the zones of weakened formation extending through the in situ oil shale retort site. Such void spaces can be formed by directing a stream of fluid against formation within a weaker zone under sufficiently high pressure for eroding, or fragmenting, disintegrating, or otherwise breaking into particles formation within the weaker zone so as to remove formation from the weaker zone to form a void within the formation layer or stratum containing the weakened formation. The zones of compact formation containing kerogen can remain in place in the retort site adjacent the void formed by such fluid pressure techniques, although caving of such compact formation can occur. Such compact zones containing kerogen can subsequently be explosively expanded toward the void space for forming a fragmented permeable mass of formation particles containing oil shale in an in situ oil shale retort.

Prior to forming such a void space in the zones of weakened formation, at least one core sample is taken from formation within the retort site to determine whether the formation strata within the retort site lend themselves to development by fluid desintegration techniques according to principles of this invention. A first core sample can be taken through essentially the entire depth of the retort site, and the resulting core sample can be analyzed for determining the location of each zone of weakened formation and the volume of formation within each zone of weakened formation. If the results of the core sample indicate that sufficient weakened formation is present within the retort site for practicing the present invention, then one or more further core samples can be taken at other locations within the retort site and be analyzed for confirming the results of the first core sample and for making a final determination as to whether the present invention can be effectively used for forming a desired void space within the retort site. For example, it is desirable that the void space formed within a retort site, prior to explosive expansion for forming a fragmented mass, occupy between approximately 15% to 25% of the total volume within the retort site. The core sample can be analyzed to determine whether a sufficient volume of formation can be removed from the weakened zones of formation for forming a void space which at least approximates the desired void volume range. The core sample, for example, can indicate that the desired void volume can be provided by removing formation solely from the zones of weakened formation, or at least that formation can be removed from the weaker zones in conjunction with other void space excavating techniques (such as forming a vertical slot or horizontal void volumes, as described above).

When it is determined from the core samples that a sufficient void volume can be formed in the weakened zones of formation, the first drift 18 at the production level is initially excavated a short distance into formation at the bottom of the retort site, as illustrated in solid lines in FIG. 1. A first raise 28 is drilled and bored from the upper base of operation 20, through formation in the retort site and into the top of the first drift 18. The first raise 28 can be a four-foot diameter circular raise drilled by conventional oil shale raise boring techniques. The first raise extends through the zones 24 containing weakened formation. A separate void 30 is then formed in a portion of each zone 24 of weakened formation adjacent the raise according to principles of this invention. Each void is formed by directing fluid, such as water, under pressure outwardly from the raise against weakened formation adjacent the raise for eroding, or fragmenting, or otherwise breaking such weaker formation into particles for removing at least a portion of the weaker formation from its formation stratum, thereby forming a void in the formation stratum containing the weaker formation. Weaker formation that is water insoluble is especially suitable for the practice of this invention. Formation particles removed from such a zone of weakened formation do not dissolve in the water, but fall under gravity or are washed through the raise and form a pile 31 of formation particles in the portion of the first drift 18 at the bottom of the raise. By measuring the amount of formation particles removed, the volume of the eroded void space can be determined. The amount of eroded formation particles can be determined by weighing such particles, and knowing their density, their volume can be calculated.

Each void can be formed by introducing a high pressure nozzle into the raise and forcing a fluid under pressure outwardly from the nozzle against the zone of weakened formation. In one embodiment, the fluid comprises a liquid, such as water, which can be jetted outwardly from the nozzle under sufficiently high pressure to erode or otherwise break into particles the formation within the weakened zone for forming the desired void within the weakened formation zone. The liquid under pressure can wash formation particles away from the resulting void and into the raise where they can fall to the bottom of the raise and into the first drift 18 for collection. In one embodiment, water is the liquid used for jetting out the voids from each weakened formation stratum and in the description to follow the liquid used for jetting out such voids is referred to as water, for simplicity, although other relatively dense and inexpensive liquids, or even gas under pressure can be used. The water used for jetting out voids sluices to the drift at the bottom of the raise and flows down an inclined floor of the raise and into a holding pond (not shown) for collection. Water from the holding pond can be recycled for continued use in water jetting operations.

In the embodiment shown in FIG. 1, a high pressure nozzle 32 is carried near a lower end of an elongated pipe 34 which is lowered through the raise 28. The high pressure nozzle 32 can face laterally outwardly from a side of the pipe 34. The inlet of the nozzle can open through the wall of the pipe so that water under pressure can be forced down through the interior of the pipe and out the outlet of the nozzle, forming a high pressure water jet 36 directed laterally outwardly against formation adjacent the outlet of the nozzle. The jet nozzle 32 can be positioned so that the high pressure water jet 36 can be directed against weakened formation for applying sufficient fluid pressure to remove formation from the zone 24 of weakened formation to form a void 30.

The pipe 34 can comprise a number of pipe sections for being releasably secured together in the base of operation 20 and lowered from the base of operation to position the jet nozzle at the level of the weakened zone being eroded. The level of each stratum and its thickness are determined from the prior core sample. The pipe can be raised or lowered for positioning the nozzle at different levels adjacent the weakened zone for jetting out the entire depth of the weakened zone. The nozzle also can be rotated about the axis of the pipe so that the water jet can be directed outwardly in infinite radial directions for eroding an areal extent of the weakened zone, i.e., a region substantially wider in radius than the thickness of the weakened zone, for forming a void 30 which can completely surround the raise. FIGS. 1 and 2 illustrate one embodiment wherein each void along the length of the raise can be generally circularly-shaped and can surround the raise as a result of changing the radial direction of the nozzle during water jetting operations.

Various means can be provided for rotating the nozzle 32 to change the radial direction of the water jet 36. In the embodiment shown in FIG. 1, the nozzle is rigidly affixed to the pipe and the pipe can be rotated about its axis to change the radial direction of the jet nozzle. The top portion of the pipe 34 can be connected to a rotary table 38 located in the base of operation for rotating the pipe. A hose 39 is connected to the top of the pipe above the rotary table for supplying water to the pipe. The nozzle can be rotated into a desired radial position and then held in place by locking the rotary table against rotation. Alternatively, the jet nozzle can be connected to a swivel (not shown) connected to a lower portion of the pipe, and rotation of the swivel can be controlled from the base of operation for changing the radial position of the nozzle. In one embodiment, the jet nozzle can be connected to a swivel which constantly rotates during use in response to fluid pressure forced through the swivel fitting and the jet nozzle.

In the embodiment shown in FIGS. 1 and 2, only one jet nozzle is used. In an alternate embodiment, a plurality of jet nozzles 32 can extend radially outwardly in different directions from the pipe 34.

In another embodiment, each jet nozzle can be releasably secured to the pipe for enabling different types of jet nozzles to be used for adjusting the force of the water jet, for example, in accordance with the type of formation being removed and its specific resistance to fluid erosion.

After a void is completed in a weakened zone, the pipe can be lowered through the raise to the level of the next weakened zone 24, and a separate void 30 is jetted out from the next zone. The pipe can be secured in each desired position within the raise by an expandable spider 40 at the lower end of the pipe 34. The spider 40 can comprise expandable legs 41 each having a separate hydraulic cylinder 42 which can be pressurized for expanding the legs 41 outwardly for clamping the bottom of the pipe 34 to the walls of the raise 28. The cylinders 42 can be retracted to free the pipe so that it can be moved to each desired level within the raise 28, after which the cylinders 42 can be pressurized for clamping the pipe 34 in its new desired position.

Figure 4:
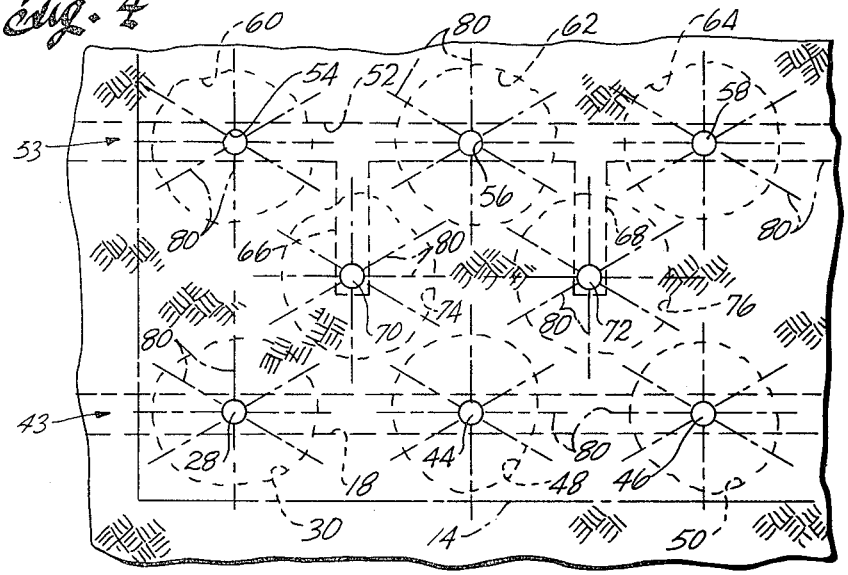
FIG. 4 is a fragmentary, semi-schematic, horizontal cross-sectional view taken along line 4—4 of FIG. 3.
Figure 3:
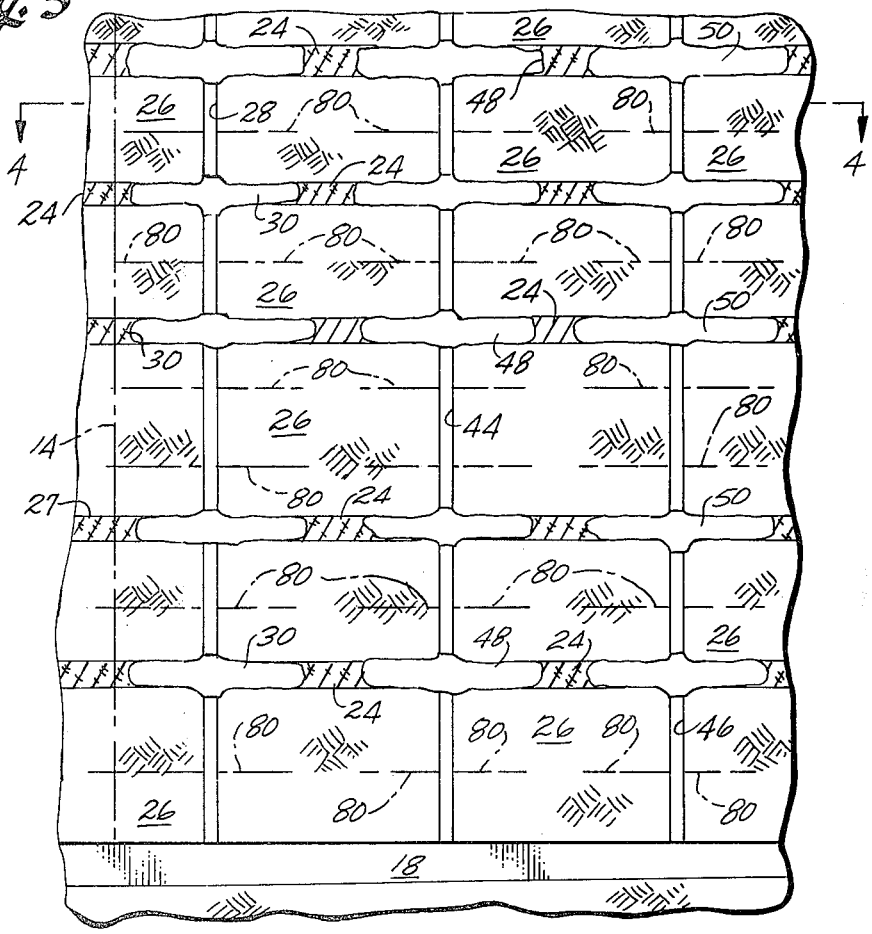
FIG. 3 is a fragmentary, semi-schematic, vertical cross-sectional view showing the in situ retort site of FIGS. 1 and 2 after formation within weakened areas is removed for forming void spaces within the retort site.

Formation is removed from each weakened zone 24 along the length of the first raise 28 before a determination is made as to whether further raise boring and void formation steps will be attempted. The purpose of such procedure is to first measure the amount of formation which has been removed from jetted out void spaces along the length of the first raise 28. This measurement of void volume provides a basis for estimating whether a sufficient void volume can be formed within the entire retort site, using the water jetting techniques of this invention, such that it will be feasible to continue forming voids using such water jetting techniques. If it is determined that the removal of formation from the weakened zones lends itself to further development according to principles of this invention, then further water jetting steps are carried out. In this instance, formation at the production level is excavated for extending the length of the first drift 18 nearly across the entire width of the retort being formed, as illustrated in phantom lines at 18 in FIGS. 1 and 2. A first row 43 of voids then can be formed along the length of the first drift 18. The first row 43 of voids is formed by boring a series of raises spaced apart along the length of the first drift 18. Each raise in the first row 43 is bored between the base of operation 20 and the first drift 18 so that each raise extends through each stratum 24 of weakened formation within the retort site. A core sample can be taken prior to boring each raise in the first row 43 of voids for determining the level and depth of each stratum 24 of weakened formation through which the raise will be bored. As illustrated in FIGS. 3 and 4, the first row 43 of voids can be formed by first boring a second raise 44 at a location spaced horizontally from and parallel to the first raise 28, and by boring a third raise 46 at a location spaced horizontally from and parallel to the second raise 44. The pipe 34 and the jet nozzle 32 then can be lowered into each raise, and the jet nozzle can be used for jetting out a separate void space in each weakened zone 24 adjacent each raise for forming a plurality of vertically spaced apart second voids 48 along the length of the second raise 44 and for forming a plurality of separate vertically spaced apart third voids 50 along the length of the third raise 46. This leaves compact zones 26 of intact, or at least unfragmented, formation containing kerogen above and below each void formed in first row 43 of voids above the first drift 18. In one embodiment, as shown in FIGS. 3 and 4, a plurality of horizontally spaced apart voids are formed within a given stratum 24 of weakened formation. Formation which has not been jetted out from between adjacent voids within such a given stratum 24 provides pillar support for formation overlying the stratum.

The exact number of raises which can be bored along the length of the first drift can depend upon the volume of formation particles likely to be removed from the weakened formation strata adjacent each raise. Formation particles which are jetted out from each weakened formation stratum collect in the drift at the bottom of each raise, and the volume of such formation particles can be measured as they are being removed from the drift. Moreover, the depth of penetration of each void 30 into its respective stratum 24 can be determined to ensure that a desired amount of formation has been jetted out from each stratum for forming each void. The depth of penetration of each void into weakened formation stratum can be determined by a variety of techniques. For example, an expandable guage (not shown) can be secured to the pipe 34, or to a separate pipe lowered through each raise, for measuring the depth of penetration of each void 30. Alternatively, a visual indication of the depth of penetration of each void can be provided by mounting a stereoscopic lens system on a pipe lowered through each raise for providing a photographic representation of the depth of penetration.

In one practice of the invention, the first row 43 of voids is formed by boring a pair of outer raises within the retort site and near opposite ends of the first drift 18. The depth of penetration of each void 30 formed along the length of each outer raise is analyzed to ensure that a desired volume of formation has been removed from each void. The volume of formation particles collected at the bottom of each raise also is measured. From this information the number of raises to be bored in the first row 43 of voids can be determined. For example, relatively fewer raises can be bored between the pair of outer raises if a relatively larger volume of formation particles is removed from adjacent each raise, whereas relatively more raises can be bored between the outer raises if a relatively smaller volume of formation particles is removed from adjacent each raise.

Weakened formation can also be jetted out from other regions of the weakened formation strata within the retort site. FIG. 4 illustrates one example of a method for removing additional formation from such weakened formation strata. A second drift 52 can be excavated on the same production level as the first drift 18. The second drift 52 can be spaced apart laterally from the first drift and can extend parallel to the first drift, as shown in FIG. 4.

A second row 53 of voids is formed along the length of the second drift 52 by first boring a plurality of longitudinally spaced apart raises along the length of the second drift. Each raise is bored between the upper working level 20 and the second drift so that each raise extends through each of the strata of weakened formation within the retort site. FIG. 4 illustrates first, second, and third longitudinally spaced apart raises 54, 56 and 58, respectively, which are bored parallel to one another along the length of the second drift.

Following completion of each raise in the second row 53 of voids, water jetting operations are conducted, as described above, for jetting out formation from weakened strata along the length of each raise in the second row. Such water jetting operations provide a series of vertically spaced apart first voids 60 formed in weakened formation strata along the length of the first raise 54, a similar series of vertically spaced apart second voids 62 along the length of the second raise 56, and a further series of vertically spaced apart third voids 64 along the length of the third raise 58. In one embodiment, as shown in FIGS. 3 and 4, the second row of voids is formed so taht voids formed in a given stratum of weakened formation are horizontally spaced apart, leaving zones of unfragmented formation between each pair of adjacent voids for providing pillar support for formation overlying such a stratum.

Lateral drifts also can be excavated on the lower production level between the first and second drifts 18 and 52, respectively, and a separate raise can be bored to each lateral drift for conducting water jetting operations for forming voids in weakened formation strata above such lateral drifts. In the example illustrated in FIG. 4, a first lateral drift 66 is excavated away from a side wall of the second drift 52 to about the midpoint of the distance between the first and second drifts. The first lateral drift 66 is excavated approximately from the midpoint between where the first and second raises 54 and 56 open into the second drift. A similar second lateral drift 68 is excavated from a side wall of the second drift 52 at about the midpoint of where the second and third raises 56 and 58 enter the second drift 52. A first intermediate raise 70 is then bored between the end portion of the first lateral drift 66 and the upper base of operation 20. The first intermediate raise 70 is thus positioned at about the midpoint between the longitudinal extent of the first and second drifts 18, 52. A similar second intermediate raise 72 is bored between the end portion of the second lateral drift 68 and upper base of operation.

Water jetting operations are then conducted along the length of the first and second intermediate raises 70, 72 for jetting out formation within weakened formation strata 24 through which the intermediate raises 70 and 72 are bored. Thus, a plurality of vertically spaced apart first voids 74 are jetted out along the length of the first intermediate raise 70, and a similar plurality of vertically spaced apart second voids 76 are jetted out along the length of the second intermediate raise 72. The voids thus formed above the lateral drifts are positioned between the voids formed in the first and second rows of raises along the length of the first and second drifts 18, 52, respectively. In the embodiment shown in FIGS. 3 and 4, the voids formed above the lateral drifts are spaced horizontally from corresponding voids formed in the first and second drifts 18, 52, respectively. This provides zones of unfragmented formation for providing pillar support between the voids formed along each intermediate raise and adjacent voids in the first and second rows 43, 53 of voids, respectively.

The void space development pattern illustrated in FIGS. 3 and 4 is exemplary only, inasmuch as other raise boring and drift excavating schemes can be used depending upon the location and volume of weakened strata within the retort site and the ease or difficulty with which such weakened strata can be jetted out for forming the voids.

Figure 5:
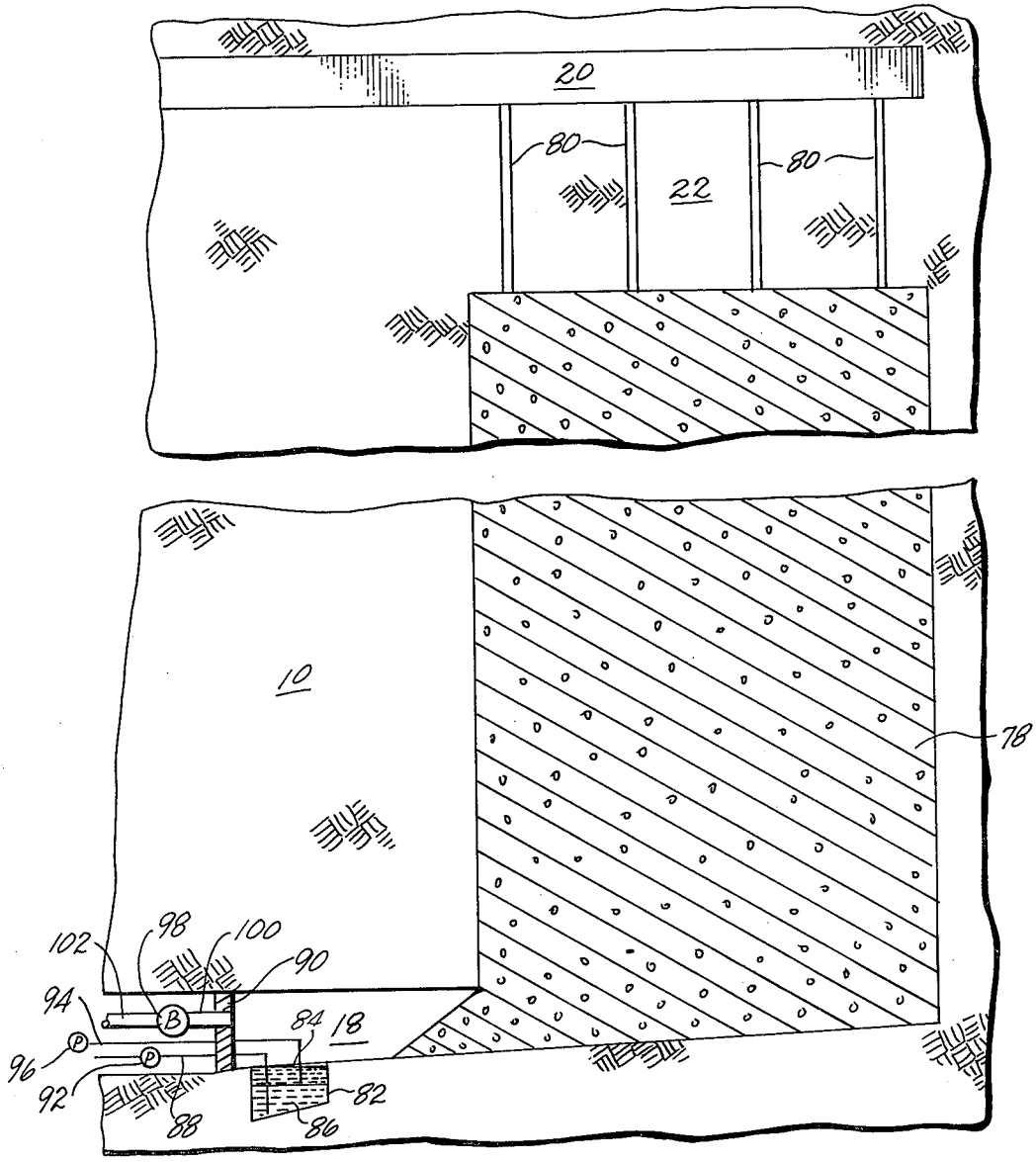
FIG. 5 is a fragmentary, semi-schematic, vertical cross-sectional view showing the in situ retort of FIGS. 3 and 4 after explosive expansion of formation for forming a fragmented permeable mass of formation particles containing oil shale in the retort site.

After the desired void space is formed within the retort site, unfragmented formation remaining within the retort site is explosively expanded toward the void space for forming a fragmented permeable mass 78 of formation particles containing oil shale in a completed in situ retort illustrated in FIG. 5. Following water jetting operations the second zones 26 of compact formation remain as regions of unfragmented formation adjacent the voids formed in the weakened formation strata 24. The voids formed by water jetting operations can provide the desired void space exclusively, or they can be used in combination with other excavation techniques for forming the desired void space prior to explosive expansion. For example, such water jetting techniques can be used in combination with a vertical slot or horizontal void volumes excavated within the retort site.

After the desired void space is provided, blasting holes are drilled into the zones 26 of compact formation and explosive is loaded into such blasting holes. FIGS. 3 and 4 illustrate one method for drilling blasting holes in zones 26 of compact formation interspersed between the voids formed in the weakened formation strata 24. In the example shown, a plurality of blasting holes, shown in phantom lines 80, are drilled radially outwardly from each raise into each zone 26 of compact formation adjacent the raise. The number of blasting holes and the amount of explosive loaded into them can be directly proportional to the the vertical thickness of a given zone 26 of compact formation. The radial blasting holes 80 can be drilled in the zones 26 of compact formation by lowering a skip (not shown) with a protective top into each raise. A workman in the skip can drill the blasting holes 80 radially outwardly from the raise. The blasting holes also can be loaded with explosive by a workman lowered into each raise. The number and pattern of blasting holes 80 shown in FIGS. 3 and 4 are exemplary only. Alternatively, vertical blasting holes (not shown) can be drilled in the zones 26 of compact formation from the base of operation 20. The vertical blasting holes can be drilled through the jetted out void spaces and the zones 26 of compact formation. Such vertical blasting holes can be sleeved, and the bottom of each blasting holes in each zone 26 of compact formation can be plugged prior to loading explosive into each vertical blasting hole.

Explosive in the blasting holes 80 can be detonated in a single round to explosively expand formation toward the free faces provided by the walls of unfragmented formation adjoining the voids formed by water jetting operations. This forms the fragmented permeable mass 78 of formation particles containing oil shale within the retort site illustrated in FIG. 4.

Alternatively, the horizontal voids can be excavated by conventional techniques, and voids for placement of explosive charges can be formed within the retort site by the water jetting techniques described above. This technique is especially desirable in a horizontal void system in which the void for receiving explosive is formed in a weakened stratum, especially over a large area of the stratum, so the major dimension of the explosive charge can be placed substantially parallel to free faces of the horizontal voids.

During retorting operations the fragmented formation particles at the top of the fragmented mass 78 are ignited to establish a combustion zone at the top of the fragmented mass. Air or other oxygen-supplying gas is supplied to the combustion zone from the base of operation 20 through passages or conduits 81 extending downwardly from the base of operation through the sill pillar 22 to the top of the fragmented mass. Air or other oxygen-supplying gas introduced to the fragmented mass maintains the combustion zone and advances it downwardly through the fragmented mass. Hot gas from the combustion zone flows through the fragmented mass on the advancing side of the combustion zone to form a retorting zone where kerogen in the fragmented mass is converted to liquid and gaseous products. As the retorting zone moves down through the fragmented mass, liquid and gaseous products are released from the fragmented formation particles. A sump 82 in the portion of the production level access drift 18 beyond the fragmented mass collects liquid products, namely, shale oil 84 and water 86, produced during operation oi the retort. A water withdrawal line 88 extends from near the bottom of the sump out through a sealed opening (not shown) in a bulkhead 90 sealed across the access drift 18. The water withdrawal line is connected to a water pump 92. An oil withdrawal line 94 extends from an intermediate level in the sump out through a sealed opening (not shown) in the bulkhead 90 and is connected to an oil pump 96. The oil and water pumps can be operated manually or by automatic controls (not shown) to remove shale oil and water separately from the sump. The inlet of a blower 98 is connected by a conduit 100 to an opening through the bulkhead 90 for withdrawing off gas from the retort through a conduit 102 to a recovery or disposal system (not shown).

Thus, the present invention provides a method for forming a void space within an in situ oil shale retort site in lieu of, or in combination with, conventional void excavating techniques. By jetting out voids in weak areas of formation, void spaces can be dispersed relatively uniformly throughout the retort site. Such water jetting operations also can form void spaces which are sufficiently interspersed throughout the retort site that some horizontal drifts need not be excavated at different levels through the retort site for gaining access to regions where voids are formed. This reduces the amount of rock bolting or "guniting" of horizontal drifts, as well as the time required for excavating such horizontal drift systems in the retort site.

What is claimed is:

1. A method for recovering liquid and gaseous products from an in situ oil shale retort in a subterranean formation containing oil shale and having at least one zone of formation within an in situ oil shale retort site that is weaker than a remaining zone of unfragmented formation within the retort site, the method comprising the steps of:

excavating a lower level drift at a lower region of the retort site;

drilling, through the retort site, a generally vertical bore hole that opens into the lower level drift;

directing fluid under pressure against the weaker zone of formation within the retort site from at least one jet nozzle placed in said bore hole adjacent said weaker zone for eroding into particle form formation from said weaker zone and removing such formation particles for forming a void in the weaker zone adjacent a remaining zone of unfragmented formation;

passing formation particles eroded from said weaker zone through the bore hole and into the lower level drift;

placing explosive in the remaining zone of unfragmented formation within the retort site;

detonating such explosive for explosively expanding such remaining zone of unfragmented formation toward the void for forming a fragmented permeable mass of formation particles containing oil shale in an in situ oil shale retort;

establishing a combustion zone in the fragmented mass;

introducing an oxygen-supplying gas to the fragmented mass for sustaining the combustion zone in the fragmented mass and for advancing the combustion zone through the fragmented mass; and withdrawing liquid and gaseous products from the fragmented mass on the advancing side of the combustion zone.

2. The method according to claim 1 including measuring the amount of formation particles passed to the lower level drift for determining the void volume of the void formed in the weaker zone of formation.

3. In a method for forming an in situ oil shale retort in a subterranean formation containing oil shale, wherein formation within a retort site in such formation is explosively expanded toward a void formed in the retort site for forming an in situ oil shale retort containing a fragmented permeable mass of formation particles containing oil shale, the improvement comprising:

excavating a lower level drift at a lower region of the retort site;

drilling, through the retort site, a generally vertical bore hole that opens into the lower level drift;

forcing fluid under pressure against a first zone of oil shale formation within the retort site, wherein formation within said first zone contains fractured oil shale formation having a relatively lower resistance to fluid erosion, for eroding such fractured formation for forming a void space in the first zone of formation adjacent a second zone of formation within the retort site having a relatively higher resistance to such fluid erosion;

passing formation eroded from the first zone of formation through the bore hole and into the lower level drift; and explosively expanding formation in the second zone of formation toward the void for forming a fragmented permeable mass of formation particles containing oil shale in an in situ oil shale retort.

4. The improvement according to claim 3 including directing a jet stream of fluid against fractured formation in the first zone from a jet nozzle placed in the bore hole adjacent the first zone of formation.

5. The improvement according to claim 4 in which the jet nozzle is on an elongated pipe placed in the bore hole; and including the steps of forcing fluid under pressure through the pipe and out the jet nozzle toward the first zone of formation for forming the void in the first zone of formation, and rotating the pipe for forming the void around the bore hole.

6. The improvement according to claim 3 including determining an amount of formation particles passed into the drift for calculating the void fraction within the retort site provided by removal of formation from the first zone of formation.

7. The improvement according to claim 6 including extending the length of the lower level drift below the retort site after the volume of said formation particles is determined.

8. The improvement according to claim 7 including drilling through the retort site and said first zone, one or more additional generally vertical bore holes that open into an extended portion of the lower level drift; and passing formation particles eroded from the first zone of formation through such an additional bore hole and into the extended portion of the drift.

9. A method for forming an in situ oil shale retort in a subterranean formation containing oil shale and having a first zone of formation within an in situ oil shale retort site that is more susceptible to erosion from fluid under pressure than a second zone of formation within the retort site, wherein formation within the retort site is explosively expanded toward a void formed within the retort site for forming a fragmented permeable mass of formation particles containing oil shale in an in situ oil shale retort site, the method comprising the steps of:

excavating a lower level drift adjacent a lower portion of the retort site;

drilling through the retort site and through the first zone of formation at least one generally vertical bore hole that opens into the lower level drift;

directing fluid under pressure outwardly from the bore hole toward the first zone of formation for eroding into particle form formation in said first zone for forming a void in the first zone adjacent the second zone of formation within the retort site;

passing formation particles eroded from the first zone of formation through the bore hole and into the lower level drift; and explosively expanding formation in the second zone of formation toward the void for forming a fragmented permeable mass of formation particles containing oil shale in an in situ oil shale retort.

10. The method according to claim 9 including directing a jet stream of fluid against formation in the first zone from a jet nozzle placed in the bore hole adjacent the first zone of formation.

11. The method according to claim 9 including determining an amount of formation particles passed from the void to the lower level drift for calculating the void fraction within the retort site provided by removal of formation from the first zone of formation.

12. The method according to claim 11 including extending the length of the lower level drift below the retort site after the volume of said formation particles is determined.

13. The method according to claim 12 including drilling through the retort site one or more additional generally vertical bore holes that open into an extended portion of the lower level drift; and passing formation particles eroded from the first zone of formation through such an additional bore hole and into the extended portion of the drift.

14. A method for forming an in situ oil shale retort in a subterranean formation containing oil shale, wherein formation within the retort site is explosively expanded toward a void formed within the retort site for forming a fragmented permeable mass of formation particles containing oil shale in an in situ oil shale retort site, the method comprising the steps of:

excavating a lower level drift adjacent a lower portion of the retort site;

drilling, through the retort site, at least one generally vertical bore hole that opens into the lower level drift;

directing fluid under pressure outwardly from the bore hole toward a first zone of formation within the retort site for eroding into particle form formation in said first zone for forming a void in the first zone adjacent a second zone of formation remaining within the retort site;

passing formation particles eroded from the first zone of formation through the bore hole and into the lower level drift; and explosively expanding formation in the second zone of unfragmented formation toward the void for forming a fragmented permeable mass of formation particles containing oil shale in an in situ oil shale retort.

15. The method according to claim 14 including directing a jet stream of fluid against formation in the first zone from a jet nozzle placed in the bore hole.

16. The method according to claim 14 including determining an amount of formation particles passed from the void to the lower level drift for calculating the void fraction within the retort site provided by removal of formation from said first zone.

17. The method according to claim 16 including extending the length of the lower level drift below the retort site after the volume of said formation particles is determined.

18. The method according to claim 17 including drilling, through the retort site, one or more additional generally vertical bore holes that open into an extended portion of the lower level drift; and passing formation particles eroded from the first zone of formation through such an additional bore hole and into the extended portion of the drift.

* * * * *